US010513998B1

(12) United States Patent
Uhrich et al.

(10) Patent No.: US 10,513,998 B1
(45) Date of Patent: Dec. 24, 2019

(54) METHOD AND SYSTEM FOR PULSED LIFT PUMP CONTROL

(71) Applicant: Ford Global Technologies, LLC, Dearborn, MI (US)

(72) Inventors: Michael Uhrich, Wixom, MI (US); Ross Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 12 days.

(21) Appl. No.: 16/017,786

(22) Filed: Jun. 25, 2018

(51) Int. Cl.

| | |
|---|---|
| ***F02D 41/26*** | (2006.01) |
| ***F02D 41/24*** | (2006.01) |
| ***F02M 37/00*** | (2006.01) |
| ***F02M 37/10*** | (2006.01) |
| *F02D 41/30* | (2006.01) |
| *F02M 37/08* | (2006.01) |

(52) U.S. Cl.
CPC ..... *F02D 41/2432* (2013.01); *F02M 37/007* (2013.01); *F02M 37/10* (2013.01); *F02D 41/3082* (2013.01); *F02M 2037/085* (2013.01)

(58) Field of Classification Search
CPC . F02D 41/2432; F02D 41/3082; F02M 37/10; F02M 37/007; F02M 2037/085
USPC ..... 123/457, 495, 497, 510, 511; 701/102, 701/103
See application file for complete search history.

(56) References Cited

U.S. PATENT DOCUMENTS

| | | | | |
|---|---|---|---|---|
| 6,557,530 | B1 | 5/2003 | Benson et al. | |
| 9,587,579 | B2 * | 3/2017 | Ulrey | F02D 41/3854 |
| 9,995,237 | B2 * | 6/2018 | Trzeciak | F02D 41/3082 |
| 10,077,733 | B2 * | 9/2018 | Trzeciak | F02D 41/3845 |
| 2014/0227107 | A1 | 8/2014 | Bauer et al. | |
| 2016/0025030 | A1 | 1/2016 | Ulrey et al. | |
| 2016/0153383 | A1 | 6/2016 | Ulrey et al. | |

* cited by examiner

*Primary Examiner* — Hai H Huynh
(74) *Attorney, Agent, or Firm* — Geoffrey Brumbaugh; McCoy Russell LLP

(57) ABSTRACT

Methods and systems are provided for calibrating a fuel lift pump. While operating in a pulsed mode, a duty cycle of the pulse is ramped in. Based on the ramp rate of the applied voltage or current relative to a resulting rate of change of the fuel pressure, a calibration gain or transfer function value is estimated and applied during subsequent fuel pump operation.

20 Claims, 9 Drawing Sheets

METHOD AND SYSTEM FOR PULSED LIFT PUMP CONTROL

FIELD

The present application relates generally to control schemes for a lift fuel pump of an internal combustion engine that operates in a pulsed mode with intermittently applied pulses of current.

BACKGROUND/SUMMARY

Some vehicle engine systems utilizing direct in-cylinder injection of fuel include a fuel delivery system that has multiple fuel pumps for providing suitable fuel pressure to fuel injectors. This type of fuel system, Gasoline Direct Injection (GDI), is used to increase the power efficiency and range over which the fuel can be delivered to the cylinder. GDI fuel injectors may require high pressure fuel for injection to create enhanced atomization for more efficient combustion. As one example, a G DI system can utilize an electrically driven lower pressure pump (i.e., a fuel lift pump) and a mechanically driven higher pressure pump (i.e., a direct injection pump) arranged respectively in series between the fuel tank and the fuel injectors along a fuel passage. In many GDI applications, the lift fuel pump initially pressurizes fuel from the fuel tank to a fuel passage coupling the lift fuel pump and direct injection fuel pump, and the high-pressure or direct injection fuel pump may be used to further increase the pressure of fuel delivered to the fuel injectors. Various control strategies exist for operating the higher and lower pressure pumps to ensure efficient fuel system and engine operation.

In one example approach, as shown by Ulrey and Pursifull in US 2016/0025030, voltage (and current) is provided to a lift fuel pump in a continuous or a pulsed manner based on a number of parameters, such as engine speed and load, and an amount of fuel to be supplied to the engine. By switching between the two modes, fuel economy is improved via pulsed lift pump operation while presence of fuel vapor at the high pressure pump inlet is avoided.

However, the inventors herein have recognized that the switching between the modes may make it difficult to self-calibrate the fuel pump controller. Typically, in feedback systems, such as the fuel systems described above, the open loop performance of the fuel system may be characterized while in steady-state (i.e. continuously powered). Centrifugal fuel pumps driven by electric motors have a pressure versus flow characteristic for any given voltage. Since in automotive applications fuel lift pumps rarely operate at the high end of the flow range (such as at 20 ml/s), lift pumps are typically calibrated by characterizing pump pressure as a function of voltage at the lower end of the flow range (such as at flow rates below 2 ml/s). An engine controller may control pump operation to a constant pressure and monitor the voltage, or control to a constant voltage and monitor the pressure. In this way, an in-tank fuel lift pump can be characterized while operating in a steady-state (i.e., the continuously powered mode). However, when in the pulsed mode, since the pump does not reach a steady-state, it may not be possible to characterize the pump. Pump variation over time comes from, the pump's resistance due to filming or a pump winding's thermal conductivity (at the current temperature) may influence the pump characterization. Pump components, such as the filming of a brush/commutator interface and a pump chamber, may wear over time due to abrasive particles moving through the pump chamber. This is particularly exacerbated when the abrasive particles are allowed to recirculate through the pump without filtering. If a pump is not characterized properly, pressure control and thus fueling accuracy may be affected.

In one example, the issues described above may be addressed by a method for a fuel system comprising: operating a lift fuel pump in a pulsed energy mode including ramping up the voltage (or current, or power, or speed) during the pulsed mode; and calibrating the lift pump based on a ramp rate during the pulses relative to a rate of change of the estimated fuel pressure. In this way, a lift pump may be characterized even while it is operated in a pulsed mode.

As one example, during operation of a fuel lift pump in a pulsed mode, the duty cycle pulse applied to an electric (DC) motor of the lift pump may be gradually ramped up. (The pump is typically controlled by a duty cycled voltage at a frequency of 10 kHz (for example). This short electrical pulses occurring each 0.0001 seconds are not the ones of which we speak. These fast occurring pulses for an effective applied voltage to the pump motor. The pulses of which we speak are the effective voltage that may be applied for 0.25 seconds to restore pressure and then shut off for 8 to 0.5 seconds until the pressure again requires restoration. Within that 0.1 to 0.4 second voltage pulse, this may include a ramping up of the applied voltage, or alternatively, of the applied power, current, or pump speed. In one example, the rate of ramping up the pump pulse may be based on a ramp speed which yields maximum electrical savings. Alternatively, the pressure rate might be further limited to limit the pressure rate of change during a scheduled injection. At the same time, the resulting fuel pressure rise rate (that is, a derivative indicative of the rate of rise in fuel pressure) may be estimated. The fuel pump is then characterized based on the ramp rate of the applied voltage ramp (during the pulse) relative to the rate of fuel pressure change. In one example, a pump gain factor is determined based on a ratio of the applied pulse and the measured rate of pressure rise. During subsequent fueling, pump operation is adjusted as a function of the newly learned gain factor.

In this way, a fuel lift pump may be operated in a pulsed mode to reduce energy consumption while providing robust characterization of the lift pump. The technical effect of applying a ramped pulse is that a change in the applied pulse (e.g., voltage or current or speed) can be better correlated with a resulting change in fuel pressure. This may allow for a better calibration of the fuel pump. This online calibration compensates for changes over manufacture or time such as brush/commutator filming, motor temperature, and pump chamber wear. By calibrating the pump reliably and accurately, fuel pressure control performance and thus overall engine fuel economy is improved. By calibrating the pump without interrupting the pulse mode of lift pump operation, the pulsed mode can be extended over a longer portion of a drive cycle, improving the associated fuel economy benefits.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
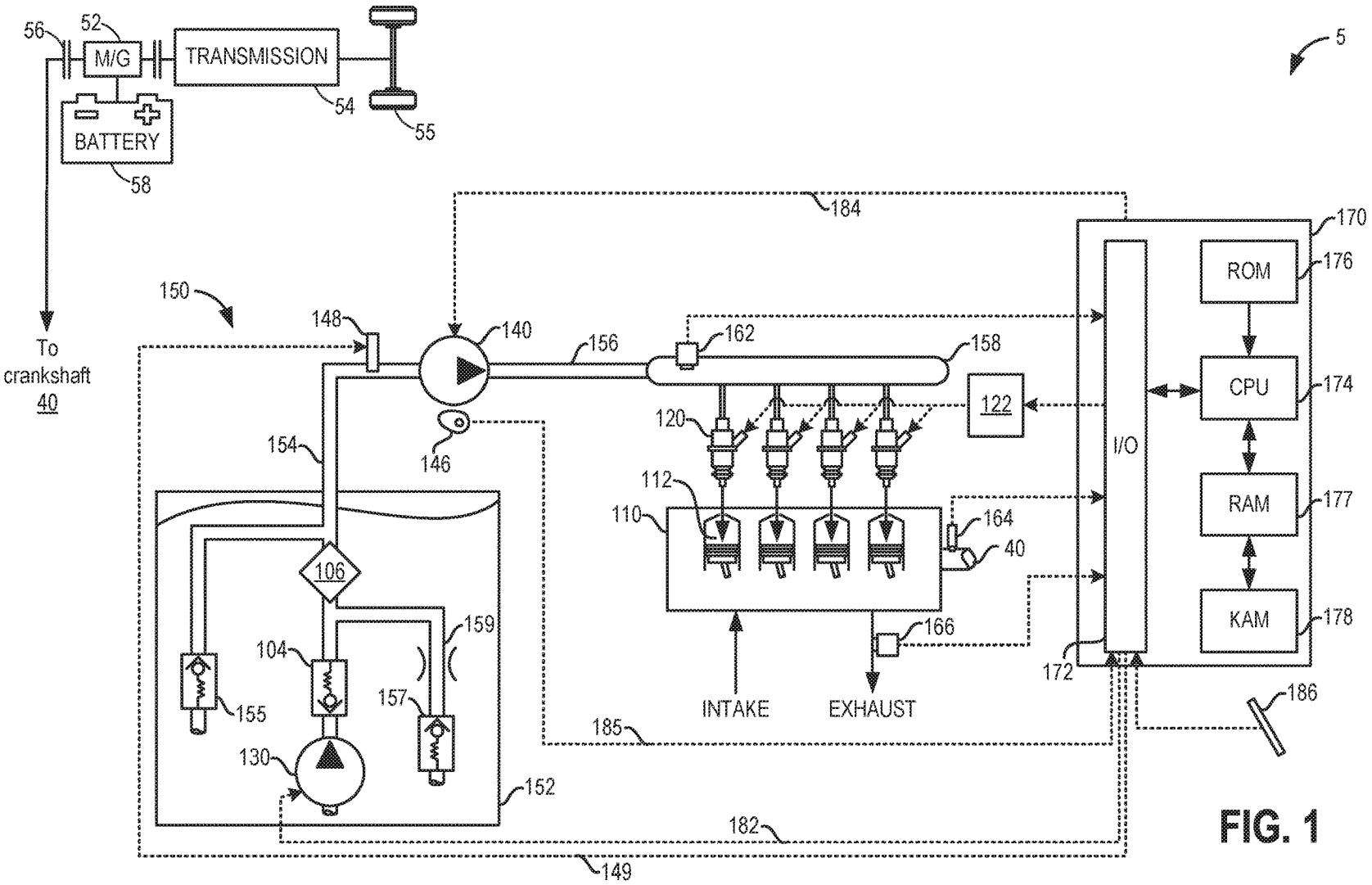
FIG. 1 shows a schematic diagram of an example fuel system coupled to an engine.
Figure 2:
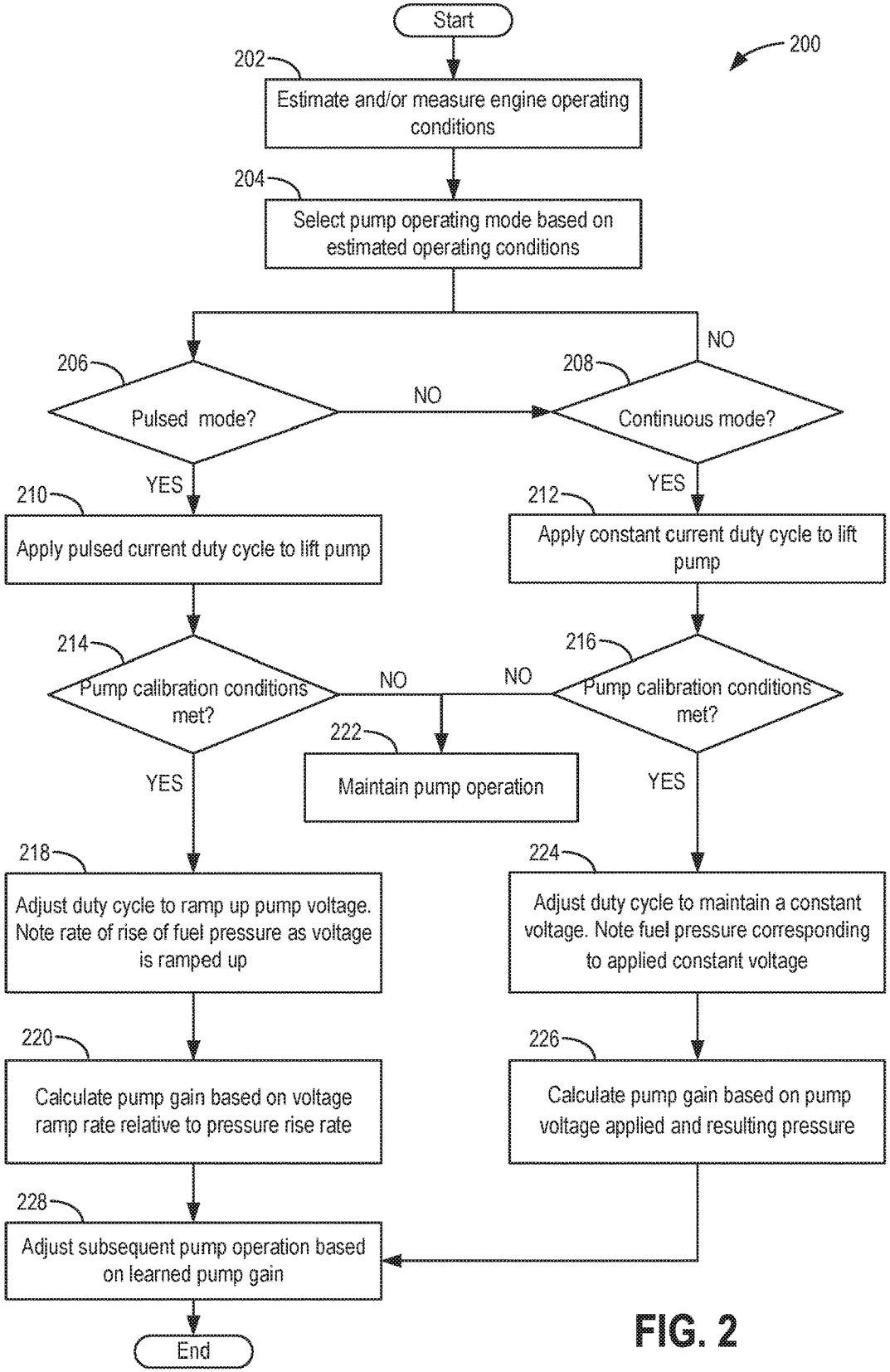
FIG. 2 shows a high level flow chart of an example method for calibrating a fuel lift pump while operating in a pulsed or a continuous mode of operation.
Figure 3:
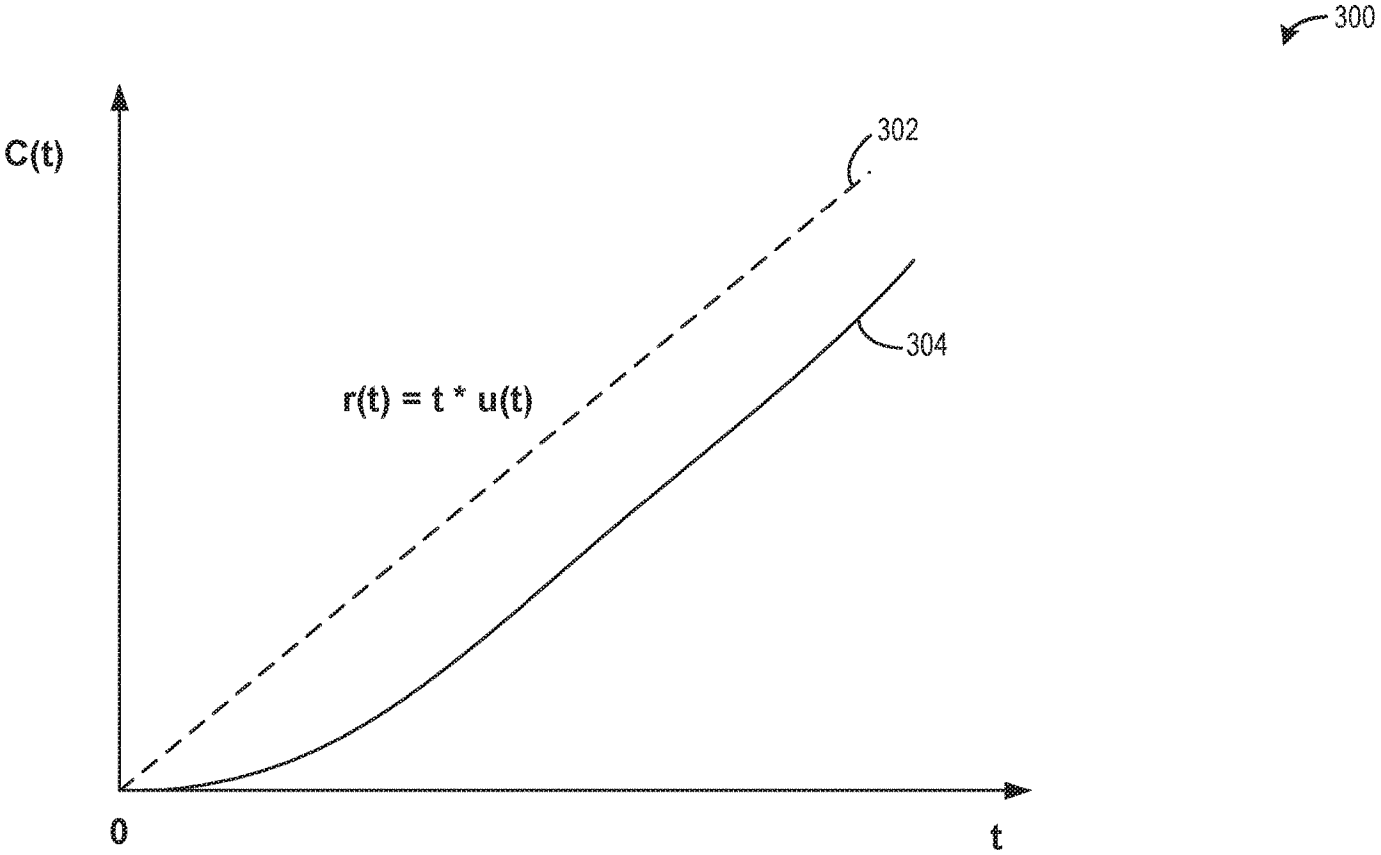
FIG. 3 shows an example unit ramp response.
Figure 4:
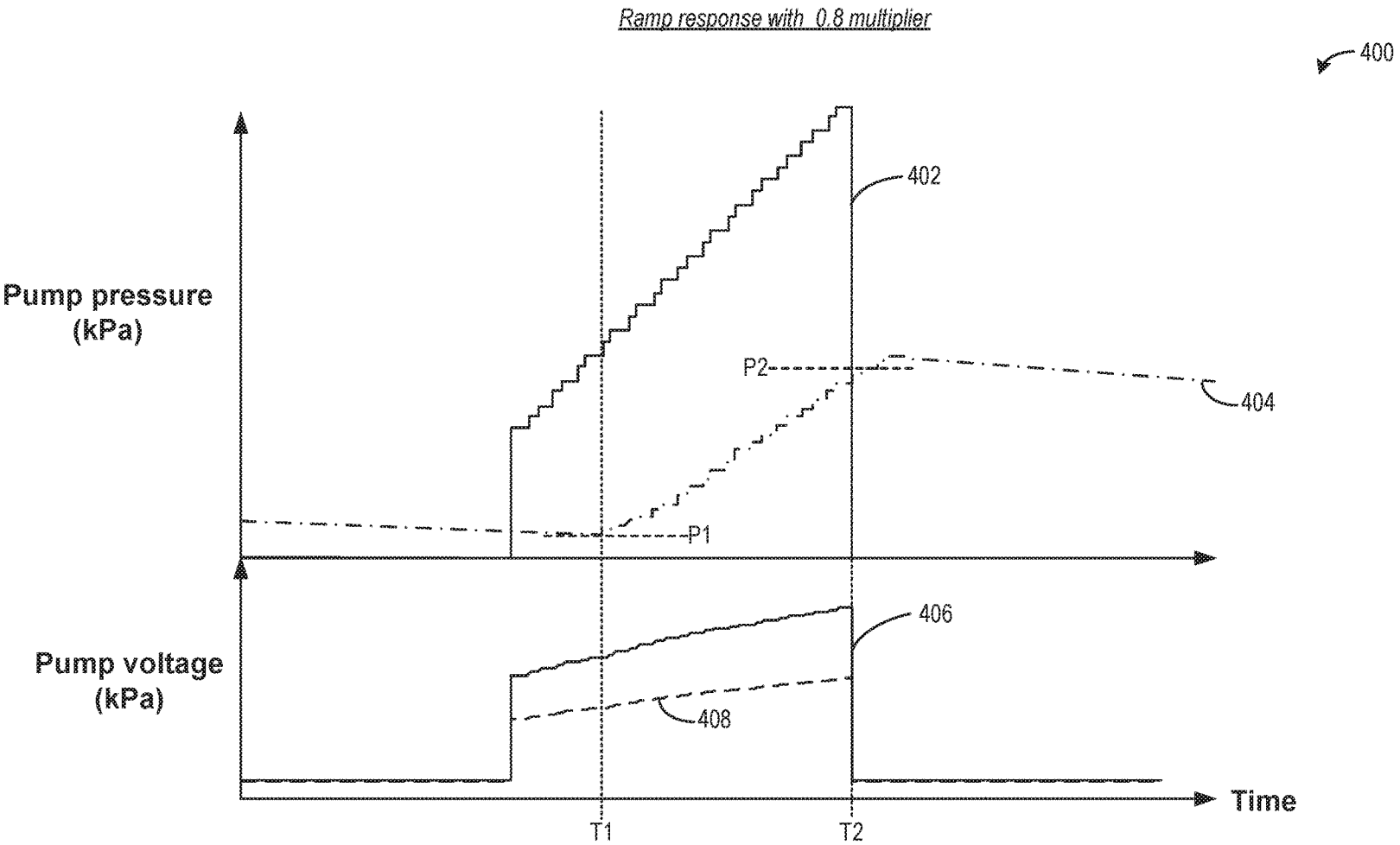
FIGS. 4-5 show example calibration profiles for a fuel lift pump.
Figure 5:
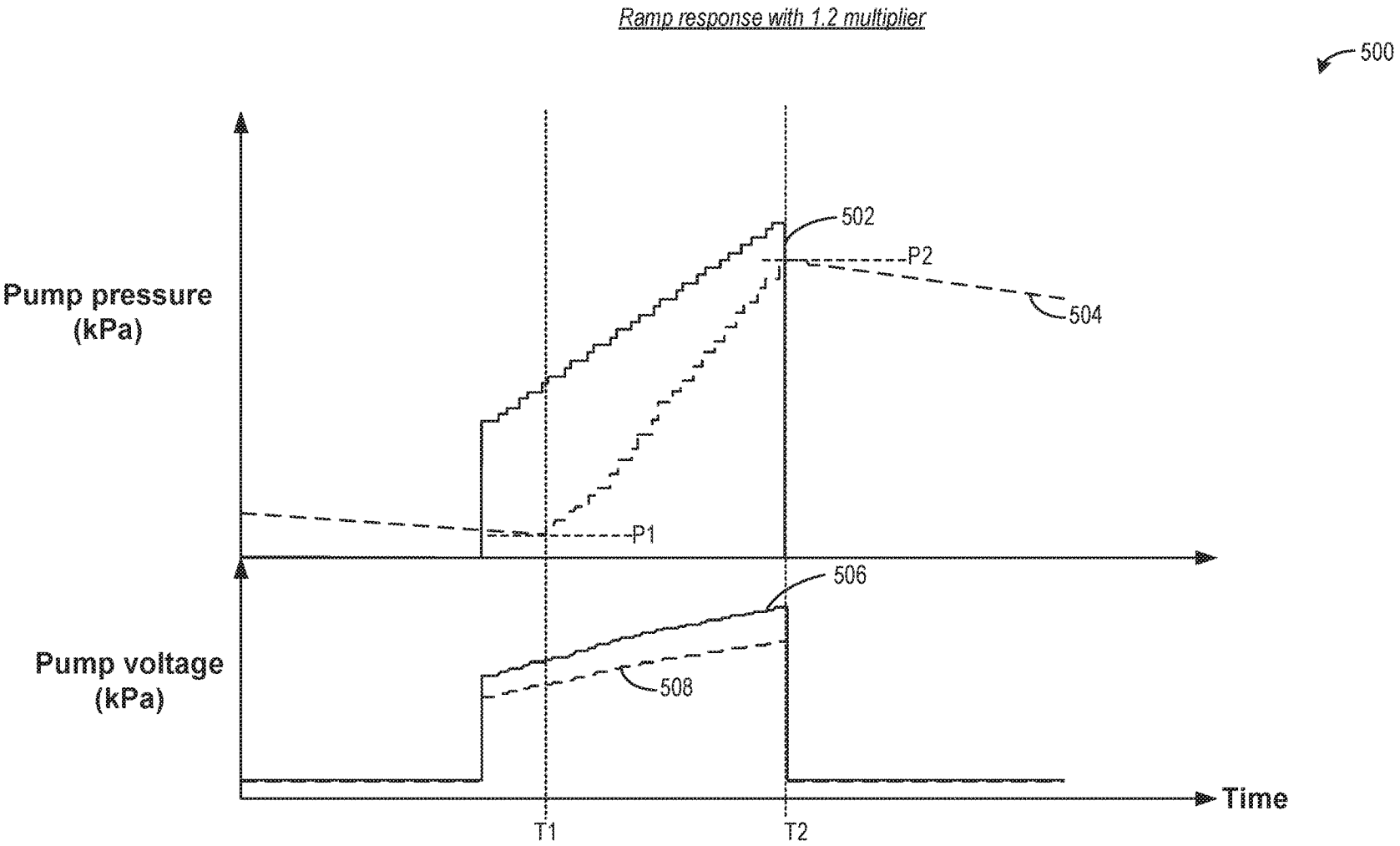
Figure 6:
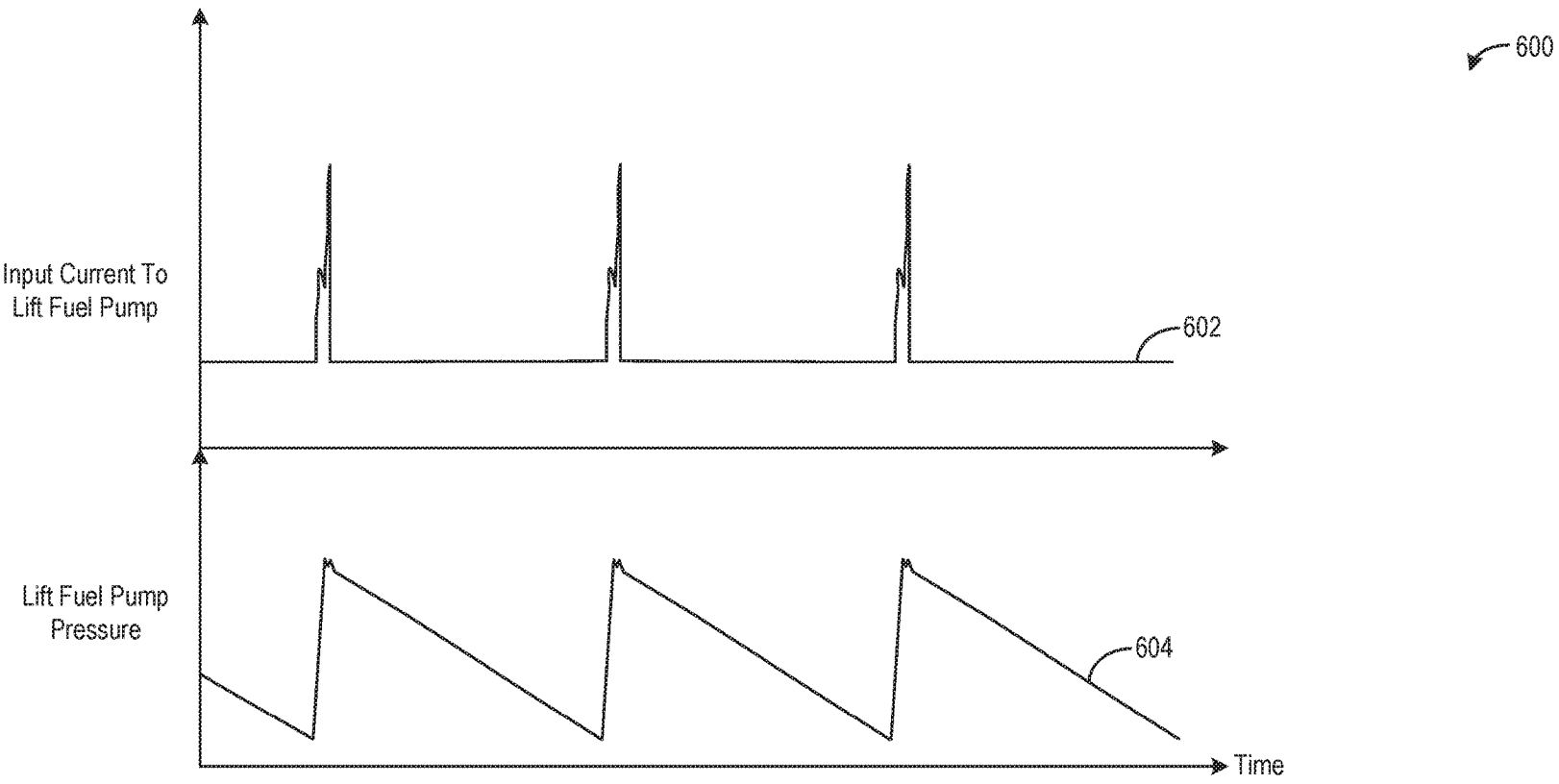
FIG. 6 shows an example approach for pressure control of a fuel lift pump via pulsing.
Figure 7:
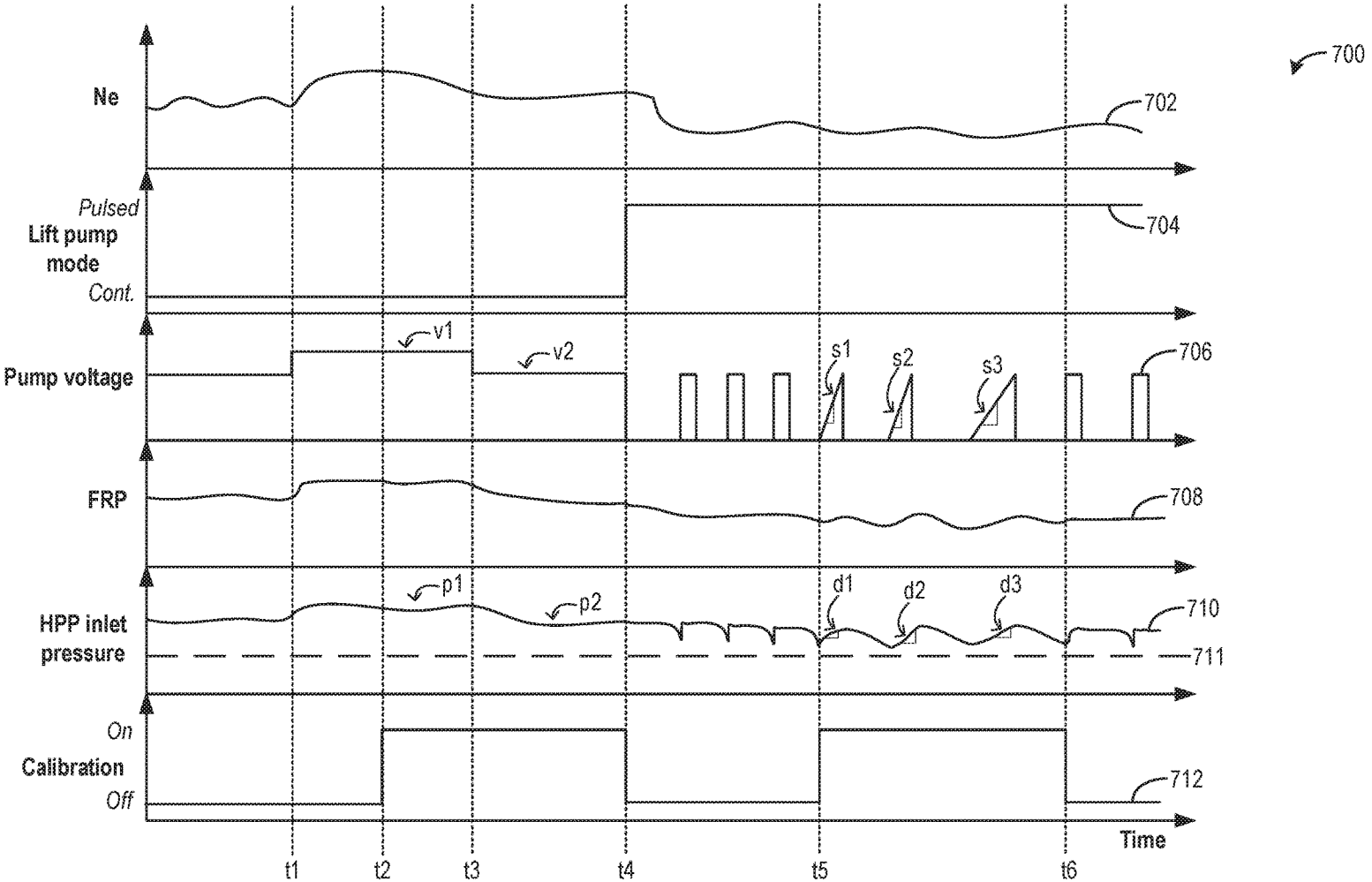
FIG. 7 shows a prophetic example of a lift pump calibration event.

The following detailed description provides information regarding a fuel lift pump, its related fuel and engine systems, and several control strategies for calibrating the lift fuel pump. A simplified schematic diagram of an example engine system, including a lift fuel pump, is shown at FIG. 1. An engine controller may be configured to perform a control routine, such as the example routine of FIG. 2, to calibrate the lift pump independent of the mode of operation of the pump (that is, while in the pulsed or continuous mode). The method of FIG. 2 is also elaborated with reference to FIGS. 8-9. An example unit response of the pump is shown graphically at FIG. 3. Example calibration profiles of the lift pump that may be generated while operation in the pulsed mode are shown at FIGS. 4-5. An example approach for pressure control of the lift pump via ramping an applied pulse is shown at FIG. 6. An example fuel system operation including a calibration event while operating in the pulsed mode is shown at FIG. 7.

Regarding terminology used throughout this detailed description, a higher-pressure fuel pump, or direct injection fuel pump, that provides pressurized fuel to a direct injection fuel rail attached injectors may be abbreviated as a DI or HP pump. Similarly, a lower-pressure pump (compressing fuel at pressures generally lower than that of the DI pump), or lift fuel pump, that provides pressurized fuel from a fuel tank to the DI pump may be abbreviated as an LP pump. A solenoid spill valve, which may be electronically energized to allow check valve operation and de-energized to open (or vice versa), may also be referred to as a fuel volume regulator, magnetic solenoid valve, and a digital inlet valve, among other names.

FIG. 1 shows a direct injection fuel system 150 coupled to an internal combustion engine 110, which may be configured as part of a propulsion system for a vehicle 5. The internal combustion engine 110 may comprise multiple combustion chambers or cylinders 112. Fuel can be provided directly to the cylinders 112 via in-cylinder direct injectors 120. As indicated schematically by arrows in FIG. 1, the engine 110 can also receive intake air and exhaust products of the combusted fuel. For simplicity, the intake and exhaust systems are not shown in FIG. 1. The engine 110 may include a suitable type of engine including a gasoline or diesel engine. In other embodiments, the combusted fuel may include other individual fuels or a combination of different fuels.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 110 and an electric machine 52. Electric machine 52 may be a motor or a motor/generator. Crankshaft 40 of engine 110 and electric machine 52 are connected via a transmission 54 to vehicle wheels 55 when one or more clutches 56 are engaged. In the depicted example, a first clutch 56 is provided between crankshaft 40 and electric machine 52, and a second clutch 56 is provided between electric machine 52 and transmission 54. Controller 170 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

Fuel can be provided to the engine 110 via the injectors 120 by way of the direct injection fuel system indicated generally at 150. In this particular example, the fuel system 150 includes a fuel storage tank 152 for storing the fuel on-board the vehicle, a low-pressure fuel pump 130 (e.g., a fuel lift pump), a high-pressure fuel pump or direct injection (DI) pump 140, a fuel rail 158, and various fuel passages 154 and 156. In the example shown in FIG. 1, the fuel passage 154 carries fuel from the low-pressure pump 130 to the DI pump 140, and the fuel passage 156 carries fuel from the DI pump 140 to the fuel rail 158. Due to the locations of the fuel passages, passage 154 may be referred to as a low-pressure fuel passage while passage 156 may be referred to as a high-pressure fuel passage. As such, fuel in passage 156 may exhibit a higher pressure than fuel in passage 154. In some examples, fuel system 150 may include more than one fuel storage tank and additional passages, valves, and other devices for providing additional functionality to direct injection fuel system 150.

In the present example of FIG. 1, fuel rail 158 may distribute fuel to each of a plurality of direct fuel injectors 120. Each of the plurality of fuel injectors 120 may be positioned in a corresponding cylinder 112 of engine 110 such that during operation of fuel injectors 120 fuel is injected directly into each corresponding cylinder 112. Alternatively (or in addition), engine 110 may include fuel injectors positioned at or near the intake port of each cylinder such that during operation of the fuel injectors, fuel is injected with the charge air into the one or more intake ports of each cylinder. This configuration of injectors may be part of a port fuel injection system, which may be included in fuel system 150. In the illustrated embodiment, engine 110 includes four cylinders that are only fueled via direct injection. However, it will be appreciated that the engine may include a different number of cylinders along with a combination of both port and direction fuel injection.

The low-pressure fuel pump 130 can be operated by a controller 170 to provide fuel to DI pump 140 via fuel low-pressure passage 154. The low-pressure fuel pump 130 can be configured as what may be referred to as a fuel lift pump. As one example, low-pressure fuel pump 130 can include an electric pump motor, whereby the pressure increase across the pump and/or the volumetric flow rate through the pump may be controlled by varying the electrical power provided to the pump motor, thereby increasing or decreasing the motor speed. For example, as the controller 170 reduces the electrical power (e.g., voltage or current) that is provided to LP pump 130, the volumetric flow rate and/or pressure increase across the pump may be reduced. Alternatively, the volumetric flow rate and/or pressure increase across the pump may be increased by increasing the electrical power (e.g., voltage or current) that is provided to the pump 130. As one example, the electrical power supplied to the low-pressure pump motor can be obtained from an alternator or other energy storage device on-board the vehicle (not shown), whereby the control system provided by controller 170 can control the electrical load that is used to power the low-pressure pump. Thus, by varying the voltage and/or current provided to the low-pressure fuel pump 130, as indicated at 182, the flow rate and pressure of the fuel provided to DI pump 140 and ultimately to the fuel rail 158 may be adjusted by the controller 170.

Low-pressure fuel pump 130 may be fluidly coupled to check valve 104 which may facilitate fuel delivery and maintain fuel line pressure. Filter 106 may be fluidly coupled to outlet check valve 104 via low-pressure passage 154. Filter 106 may remove small impurities that may be contained in the fuel that could potentially damage fuel handling components. With check valve 104 upstream of the filter 106, the compliance of low-pressure passage 154 may be increased since the filter may be physically large in volume. Furthermore, pressure relief valve valve 155 includes a ball and spring mechanism that seats and seals at a specified pressure differential to relieve fuel to limit the fuel pressure at 154. Passage 159 supports lift pump operation whose purpose is to fill a reservoir within the tank. As seen in FIG. 1, check valve 104 is oriented such that fuel backflow from DI pump 140 to the low-pressure pump 130 is substantially reduced (i.e., eliminated). In some embodiments, fuel system 150 may include a series of check valves fluidly coupled to low-pressure fuel pump 130 to further impede fuel from leaking back upstream of the valves. In this context, upstream flow refers to fuel flow traveling from fuel rail 158 towards low-pressure pump 130 while downstream flow refers to the nominal fuel flow direction from the low-pressure pump towards the fuel rail.

Next, fuel may be delivered from check valve 104 to high-pressure fuel pump (e.g., DI pump) 140. DI pump 140 may increase the pressure of fuel received from the check valve 104 from a first pressure level generated by low-pressure fuel pump 130 to a second pressure level higher than the first level. DI pump 140 may deliver high pressure fuel to fuel rail 158 via high-pressure fuel line 156. Operation of DI pump 140 may be adjusted based on operating conditions of the vehicle in order to provide more efficient fuel system and engine operation.

The DI pump 140 can be controlled by the controller 170 to provide fuel to the fuel rail 158 via the high-pressure fuel passage 156. As one non-limiting example, DI pump 140 may utilize a flow control valve, a solenoid actuated "spill valve" (SV), or fuel volume regulator (FVR) to enable the control system to vary the effective pump volume of each pump stroke. The spill valve may be separate or part of (i.e., integrally formed with) DI pump 140. The DI pump 140 may be mechanically driven by the engine 110 in contrast to the motor driven low-pressure fuel pump or fuel lift pump 130. A pump piston of the DI pump 140 can receive a mechanical input from the engine crank shaft or cam shaft via a cam 146. In this manner, DI pump 140 can be operated according to the principle of a cam-driven, single-cylinder pump. Furthermore, the angular position of cam 146 may be estimated (i.e., determined) by a sensor located near cam 146 communicating with controller 170 via connection 185. In particular, the sensor may measure an angle of cam 146 measured in degrees ranging from 0 to 360 degrees according to the circular motion of cam 146. While cam 146 is shown outside of DI pump 140 in FIG. 1, it is understood that cam 146 may be included in the system of DI pump 140.

As such, the above-described fuel system may be applied to a DI, PFI, or PFDI configuration. When applied to DI systems, the intermittent lift pump operation does not affect DI injection pressure. When applied to PFI and PFDI systems, the intermittent lift pump operation affects PFI injection pressure, but that is permissible.

As depicted in FIG. 1, a fuel pressure sensor 148 is disposed downstream of the fuel lift pump 130. The sensor may be referred to as the lift pump pressure sensor or the low-pressure sensor.

As shown in FIG. 1, the fuel rail 158 includes a fuel rail pressure sensor 162 for providing an indication of fuel rail pressure to the controller 170. An engine speed sensor 164 may be coupled to crankshaft 40 and can be used to provide an indication of engine speed to the controller 170. The indication of engine speed can be used to identify the speed of DI pump 140, since the pump 140 is mechanically driven by the engine 110, for example, via the crankshaft or camshaft. An exhaust gas sensor 166 can be used to provide an indication of exhaust gas composition to the controller 170. As one example, the gas sensor 166 may include a universal exhaust gas sensor (UEGO). The exhaust gas sensor 166 can be used as feedback by the controller 170 to adjust the amount of fuel that is delivered to the engine 110 via the injectors 120. In this way, the controller 170 can control the air/fuel ratio delivered to the engine to a prescribed set-point.

Furthermore, controller 170 may receive other engine/exhaust parameter signals from other engine sensors such as engine coolant temperature, engine speed, throttle position, absolute manifold pressure, emission control device temperature, etc. Further still, controller 170 may provide feedback control based on signals received from fuel sensor 148, pressure sensor 162, and engine speed sensor 164, among others. For example, controller 170 may send signals to adjust a current level, current ramp rate, pulse width of a solenoid valve (SV) of DI pump 140, and the like via connection 184 to adjust operation of DI pump 140. Also, controller 170 may send signals to adjust a fuel pressure set-point of a fuel pressure regulator and/or a fuel injection amount and/or timing based on signals from fuel sensor 148, pressure sensor 162, engine speed sensor 164, and the like. Other sensors not shown in FIG. 1 may be positioned around engine 110 and fuel system 150.

The controller 170 can individually actuate each of the injectors 120 via a fuel injection driver 122. The controller 170, the driver 122, and other suitable engine system controllers can comprise a control system. While the driver 122 is shown external to the controller 170, in other examples, the controller 170 can include the driver 122 or the controller can be configured to provide the functionality of the driver 122. The controller 170, in this particular example, includes an electronic control unit comprising one or more of an input/output device 172, a central processing unit (CPU) 174, read-only memory (ROM) 176, random-access memory (RAM) 177, and keep-alive memory (KAM) 178.

The storage medium ROM 176 can be programmed with computer readable data representing non-transitory instructions executable by the processor 174 for performing the methods described below as well as other variants that are anticipated but not specifically listed. For example, controller 170 may contain stored instructions for executing various control schemes of DI pump 140 and LP pump 130 based on several measured operating conditions from the aforementioned sensors. As another example, the controller 170 receives signals from the various sensors of FIG. 1 and employs the various actuators of FIG. 1 to adjust engine operation based on the received signals and instructions stored on a memory of the controller.

As shown in FIG. 1, direct injection fuel system 150 is a returnless fuel system, and may be a mechanical returnless fuel system (MRFS) or an electronic returnless fuel system (ERFS). In the case of an MRFS, the fuel rail pressure may be controlled via a pressure regulator (pressure relief valve 155) positioned at the fuel tank 152. In an ERFS, a pressure sensor 162 may be mounted at the fuel rail 158 to measure the fuel rail pressure; however, the open loop scheme described herein relegates the pressure sensor 162 to diagnostic purposes only and thus inclusion of the pressure sensor is discretionary. The signal from the pressure sensor 162 may be fed back to the controller 170, which controls the driver 122, the driver 122 modulating the voltage to the DI pump 140 for supplying the correct pressure and fuel flow rate to the injectors.

Although not shown in FIG. 1, in other examples, direct injection fuel system 150 may include a return line whereby excess fuel from the engine is returned via a fuel pressure regulator to the fuel tank via a return line. The fuel pressure regulator may be coupled in-line with the return line to regulate fuel delivered to fuel rail 158 at a set-point pressure. To regulate the fuel pressure at the set-point, the fuel pressure regulator may return excess fuel to fuel tank 152 via the return line upon fuel rail pressure reaching the set-point. It will be appreciated that operation of the fuel pressure regulator may be adjusted to change the fuel pressure set-point to accommodate operating conditions.

Various techniques may be used to control the energy input into the lift fuel pump 130 of FIG. 1, wherein the energy is provided to the pump via connection 182, as described previously. For example, the lift fuel pump may be alternated between operating in a continuous mode and a pulsed mode based on engine operating conditions to reduce power consumption while also reducing fuel vapor formation at the DI pump inlet. In the context of the present disclosure, continuous pump operation (herein also referred to as the continuous mode) includes supplying a substantially constant current (i.e., power or energy) to the lift pump. However, when fuel flow demand changes, then the current may be adjusted to a different level, wherein the different level is held substantially constant while the desired fuel flow is provided. In comparison, pulsed pump operation (herein also referred to as the pulsed mode) includes supplying current to the lift pump for a limited time duration. Within this context, the limited time duration may be a threshold such as 0.3 seconds or another suitable quantity depending on the engine and fuel systems. In between pump pulsation events, no current is provided to the lift pump, thereby ceasing pump operation in between pulsation events.

For example, a lift pump "on" duration can be adjusted to be a function of the DI pump inlet pressure. The lift pump can be sized to have a large dynamic range that corresponds to the engine's fuel consumption dynamic range. For example, at one engine speed and load an engine may consume 25 cc/sec while at another operating condition it consumes 0.3 cc/sec. By adjusting the operating mode of the lift pump, the injection pump (herein the DI pump) can be supplied fuel at varying pressures without compromising the ability to control fuel pressure in the fuel rail. For example, the lift pump may be operated intermittently while a valve at the inlet side of the injection pump is adjusted to maintain a desired pressure in the fuel rail.

The fuel lift pump may also need to be intermittently calibrated. Therein, typically an engine controller may control pump operation to a constant pressure and monitor the voltage, or control to a constant voltage and monitor the pressure, while the pump is in the continuous mode. However, when in the pulsed mode, since the pump does not reach a steady-state pressure, it may not be possible to characterize the pump. The open loop pump characterization may change because of the pump's resistance due to filming or a pump winding's thermal conductivity (at the current temperature) may influence the pump characterization. Pump components, such as the filming of a brush/commutator interface and a pump chamber, may wear over time due to abrasive particles moving through the pump chamber. This is particularly exacerbated when the abrasive particles are allowed to recirculate through the pump without filtering. If a pump is not characterized properly, fuel pressure control and thus fueling accuracy may be affected.

As elaborated herein with reference to FIG. 2, the lift pump may be calibrated while operating in the pulsed mode by ramping up the applied voltage (within the pulse) and monitoring the resulting rate of change of fuel pressure. In one example, while operating the lift pump in the pulsed mode, controller 170 may send a control signal to an electric motor of pump 130 to gradually ramp up an applied pulse while observing the rate of increase of fuel pressure via pressure sensor 162. Based on a ratio of the rate of pulse ramping up relative to the rate of increase of fuel pressure, a pump gain value may be determined. This value, which may be a multiplier for example, may then be applied to a commanded pump pulse during subsequent pump operation thus self-adjusting for changes in pump performance.

Turning now to FIG. 2, an example method 200 is shown for operating the fuel lift pump in differing modes (e.g., selecting between a continuous mode and a pulsed mode) based on engine operating conditions, and adjusting a calibration routine of the pump based on the selected mode of pump operation. To gain the electrical power savings associated with intermittently operating the lift pump, the predominant mode is intermittent. In certain rarer conditions, continuous operation may be chosen with little impact on typical electrical power consumption, thus little impact on fuel economy. Instructions for carrying out method 200 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 202, the method includes estimating and/or measuring engine operating conditions. These include, for example, driver torque demand, engine speed, engine load, engine fuel flow rate (actual or desired), ambient conditions such as ambient air temperature, pressure, and humidity, fuel rail pressure, manifold air flow and pressure, and exhaust air-fuel ratio.

At 204, the method includes selecting a pump operating mode based on the estimated operating conditions. The lift pump may be operated intermittently in a pulsed mode wherein the pump is intermittently turned on and off, and wherein during the off period the pump speed goes to zero. The lift pump may alternatively be operated in a continuous mode wherein it is operated continuously at a level. In one example, engine speed and load are used to index a table that outputs a particular desired mode. The desired modes can be empirically determined by performing tests at different engine operating conditions. As an example, the lift pump may be operated in the pulsed mode at lower engine speeds and loads. During these conditions, fuel flow to the engine is low and the lift pump has the capacity to supply fuel at a rate that is higher than the engine's fuel consumption rate. Therefore, the lift pump can be turned off while the engine continues to operate (i.e., combusting air-fuel mixtures) for a duration (e.g., one to 8 seconds) before the lift pump has to be restarted.

As another example, during higher engine speeds and engine fuel injection rates, the lift pump may be operated in the continuous mode. In one embodiment, the lift pump is operated continuously when the lift pump's off time drops below a threshold time, such as 0.5 seconds. However, if desired, the off time level that triggers continuous lift pump operation can be adjusted to be 0.3 or 0.8 seconds if desired. In another embodiment, the lift pump is operated continuously when the mean fuel flow rate injected to the engine exceeds a predetermined level.

At 206, it may be determined if the pulsed mode of lift pump operation has been selected. If yes, then at 210, the method includes applying a pulsed current duty cycle to the lift pump. Alternatively, a pulse of voltage or electrical power is provided. Whether in continuous mode or in intermittent mode an effective voltage is applied on the pump by a duty cycling pump power at a fast rate (e.g. 10 kHz). For example, the controller may power the electrical motor of the lift pump for a predefined duration, which is shorter than a threshold. An amplitude (or magnitude) of the pulse may be adjusted based on the engine fuel flow (or DI fuel pressure) desired, which in turn is determined as a function of the current engine operating conditions. For example, as the fuel flow demanded increases, frequency of the pressure-restoring pulse may increase. The pulse duration is largely constant but may vary as its duration continues until a defined pressure level is reached (or will be reached). Electrical power may be provided to the lift pump at the determined level of the pulse for the defined duration of the pulse and then power supply may be terminated. In other words, between the end of the present pulse and the start of the next pulse, the pump does not received any electrical power and does not operate. It will be appreciated that at the onset of the next pulse, based on the current engine operating conditions, a size of the pulse (including an amplitude and a duration of the pulse) may be varied to meet the current fuel flow demand. Typically the pulse terminates when the target pressure is reached or will be reached.

If not, at 208, it may be determined that the continuous mode of lift pump operation has been selected. Accordingly, at 212, the method includes applying a continuous current (or voltage or electrical power) duty cycle to the lift pump. For example, the controller may power the electrical motor of the lift pump at a level based on the engine fuel flow (or DI fuel pressure) desired, which in turn is determined as a function of the current engine operating conditions. For example, as the pressure or fuel flow rate demand increases, the output of the continuous pump operation may be increased. Electrical power may be provided to the lift pump at the determined level and power supply may not be terminated. It will be appreciated that if the engine operating conditions change and result in a different fuel flow requirement, the magnitude of the electrical power provided to the lift pump motor may be varied while maintaining the continuous pump operation. For example, responsive to an increase in fuel flow or pressure demand, the pump output may be increased and then held at the increased level until a further change in engine operating conditions necessitate a further change in pump output.

While operating in the pulsed mode with a pulsed current, or voltage, or electrical power, being provided to the lift pump, at 214, it may be determined if pump calibration conditions have been met. Likewise, while operating in the continuous mode with a continuous current, or voltage, or electrical power, being provided to the lift pump, at 216, it may be determined if pump calibration conditions have been met.

If pump calibration conditions are not met, the method moves to 222 to maintain pump operation. Else, if pump calibration conditions are met while operating in the pulsed mode, the method moves to 218 to calibrate the pump while in the pulsed mode. This includes adjusting the slope of the applied voltage ramp to adjust the pressure rate to the desired rate.

For example, if the desired pressure rate is 1000 kPa/s, then the pump voltage is increased at a rate that would result in a pressure rate of 1000 kPa/s. However, since it takes some time for the pump to respond (i.e. spin up) the actual pressure ramp is delayed. However the commanded rate is identical to the resultant rate, even though the pressure command is delayed. Now, if the pump has lower than nominal performance, the actual rate is below the commanded rate. By adjusting a gain, the commanded and actual can be made to be the same, thus compensating for varying performance during pulsed operation.

While ramping up the electrical power provided to the pump during the pulse, a resulting rate of rise of fuel pressure is noted. The method then moves to 220. The inventors herein have recognized that even when the pulse duration is short (e.g., in the order of 0.2 seconds), the fuel lift pump can be characterized by ramping up the applied voltage. In particular, the resulting pressure ramps up at a rate that corresponds to the pump performance, allowing for the pump to be calibrated. It will be appreciated, however, that the ramping up of the applied voltage during the pulsed mode is distinct from a step response assessment, as may be used while in the continuous mode.

For example, the controller ramp up to the desired pressure at a pre-programmed rate. Pressure is mapped to voltage via a steady state characterization between commanded pressure, present flow rate, and applied voltage. In a nominal pump (no gain adjustment required, the commanded pressure rate is equal to the measured pressure rate, and the thus appropriate gain is unity.

At 220, a pump gain value is calculated based on the voltage ramp rate relative to the fuel pressure rise rate. For example, a ratio of the voltage ramp rate relative to the fuel pressure rise rate is determined and used to calculate a multiplier. In one example, the controller may collect at least two data points over a given pulse. Still additional data points may be collected over the same pulse, or over multiple consecutive pulses, to enable the monotonic, causal relation to be mapped. The at least two data points collected over a given pulse may include a first pressure data point (P1) collected at a first time point (T1) when the fuel pressure first rises above a threshold, the threshold set at or near a trough pressure (fpump_p_gage_des) or minimum fuel pressure. The data points may further include a second pressure data point (P2) collected at a second time point (T2) where the applied pump voltage goes to zero. This may correspond close to the highest pressure in the pulse. In some examples, the second data point may be collected when the pressure reaches an upper threshold or peak pressure, however, for a weak pump, it may not reach the peak pressure. A slope is then computed as rise of pressure over run of voltage. In other words, a derivative of the change in the pressure is determined. The slope may be calculated as: Slope=(P2−P1)/(T2−T1) in units of kPa/sec.

If the intended pressure rate is 1000 kPa/s and the measured pressure rate is 800 kPa/s one needs to increase the "adjustment factor". And the most likely adjust is 1/0.8=1.25.

If the pump calibration conditions are met in the continuous mode, the method moves to 224 to calibrate the pump while in the continuous mode. This includes adjusting the duty cycle of the applied electrical power to maintain a constant voltage or constant current. At the same time, a fuel pressure resulting from the applied constant voltage is determined. The method then moves to 226.

In some examples, the pump may be calibrated in the continuous mode via a step response assessment wherein a level of the applied constant voltage is stepped up or stepped down and the resulting rise or drop, respectively, in pressure is noted. However, it will be appreciated that the stepped response assessment of the continuous mode calibration is distinct from the ramped pulse of the pulse mode calibration.

At 226, a pump correction factor, such as a gain value, is calculated based on the voltage applied relative to the resulting fuel pressure. For example, a ratio of the voltage applied relative to the resulting fuel pressure may be used to calculate a multiplier. As an alternate example, a difference between the fuel pressure expected based on the applied voltage and the actual fuel pressure resulting from the applied voltage is used to calculate a multiplier or addend.

In one example, the controller may collect at least two data points over the duration of the continuous mode. Still additional data points may be collected to enable the monotonic, causal relation to be mapped. The at least two data points collected over a duration may include a first pressure data point (P1) collected at a first time point (T1) and a second pressure data point (P2) collected at a second time point (T2) after a threshold duration has elapsed. A multiplier is then computed as a function of the difference between the pressures. That is, the multiplier is calculated as: Multiplier=f(P2−P1) in units of kPa. Alternatively, an addend is calculated as: Addend=f(P2−P1) in units of kPa. In one example, the controller may measure the pressure rate from two ordered pairs of pressure, and time data points. The controller may then compute the slope. Then, the controller may adjust a gain factor to get that slope closer to the intended slope.

From each of 220 and 226, the method then moves to 228 to adjust subsequent pump operation based on the learned pump correction factor (e.g., gain value). As an example, where the learned correction factor is a multiplier, subsequent pump operation may be corrected via the multiplier. For example, the commanded signal may be multiplied by the multiplier to determine the actual signal to be provided to the lift pump. As another example, the addend may be added to the commanded signal to determine the actual signal to be provided to the lift pump. The method then ends.

As such, if the ramp response of the fuel lift pump followed first order control system dynamics, then a unit ramp response would be observed. FIG. 3 shows a graph 300 of a unit ramp response of the fuel lift pump. Graph 300 depicts an expected ramp response at plot 302 (dashed line) and an actual ramp response at plot 304 (solid line). As shown, the unit ramp response, c(t), follows the unit ramp signal for all positive values of t. However there is a deviation of T units from the input signal.

FIG. 3 shows the response of an example system to a ramp input. Note that the slopes are preserved in this case while the measured value lags the commanded value. The intended pressure is analogous to 320. The measured pressure is analogous to 304. If the slopes are identical, no gain adjustment is required.

Figure 8:
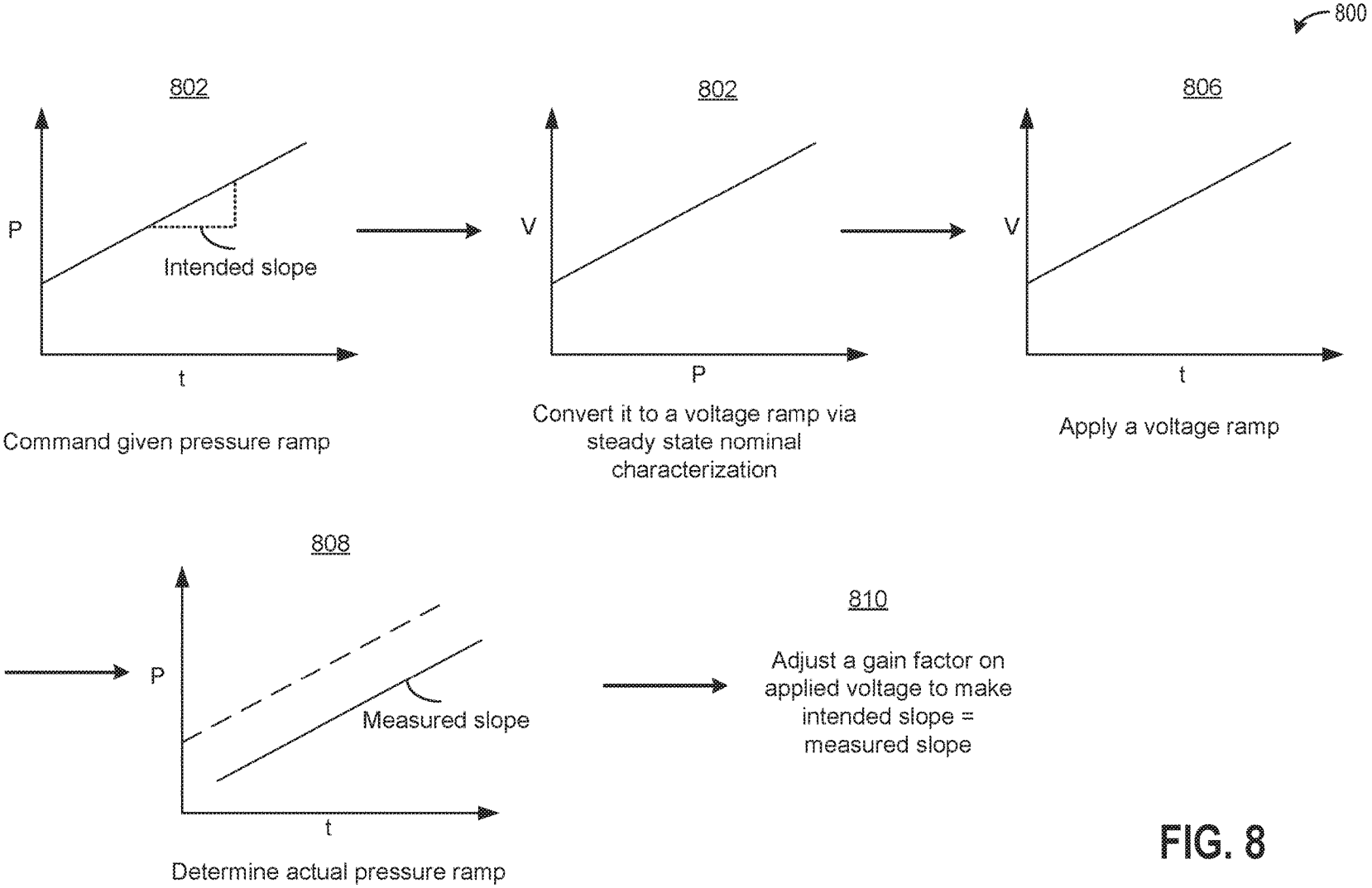
FIG. 8 shows an example approach for learning a pump transfer function based on a difference between a desired pressure ramp rate and an actual pressure ramp rate, according to the present disclosure.
Figure 9:
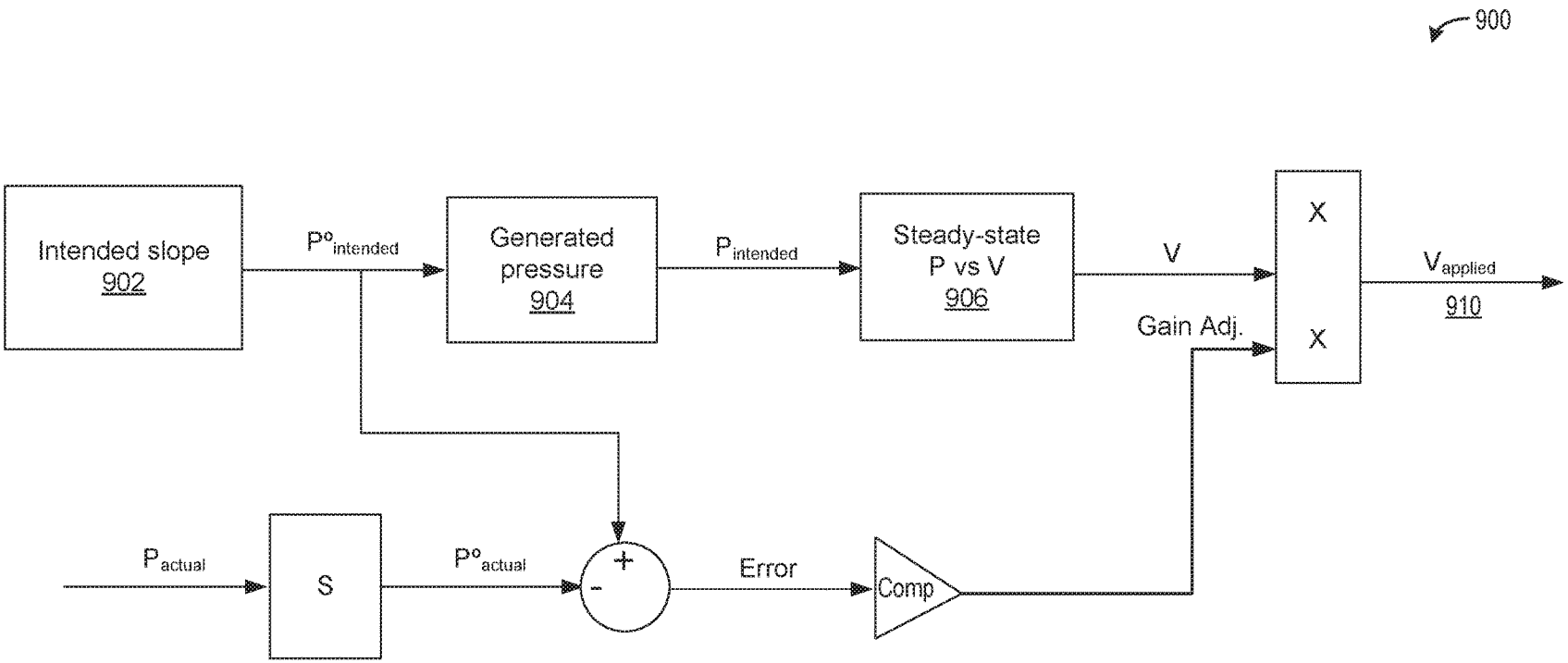
FIG. 9 shows a block diagram of a control loop for adjusting a ramp rate commanded to a lift pump based on a measured pressure ramp rate downstream of a lift pump during application of a ramped duty cycle.

An implementation of the method of FIG. 2 is shown with reference to FIG. 8, and the control loop of FIG. 9. FIG. 8 shows, at 800, various steps that may be used to calibrate the lift pump during a pulsed energy mode of operation. Specifically, at 802, a desired pressure ramp is determined. Therein pressure is mapped as a function of time, and the desired ramp rate is shown by the intended slope. At 804, the desired pressure ramp is converted to a voltage ramp via a steady-state nominal characterization. As a result, the fuel pump data is plotted as a function of voltage over pressure. At 806, a voltage ramp is applied to the fuel pump. Herein, voltage is applied as a function of time with voltage increasing over a duration of a given pulse. It will be appreciated that in alternate examples, pump speed or the applied current may be ramped up. At 808, the actual pressure ramp is measured. For example, the actual pressure ramp rate (solid line) resulting from the voltage ramped pulse is compared to the desired pressure ramp rate (dashed line, the desired pressure ramp rate determined earlier at 802). Based on a difference between the commanded pressure ramp rate and the actual (measured or sensed) pressure ramp rate (e.g., based on a positive difference between the slopes of the two lines), a gain factor or value is determined. This gain value is a proportioning function via which the commanded pressure ramp rate (that is, applied voltage command) can be multiplied so that the desired pressure ramp rate is actually achieved. Example profiles where the gain is 0.8 and 1.2, respectively, are shown at FIGS. 4-5.

FIG. 9 depicts the method of FIG. 8 as a block diagram. Map 900 depicts an intended slope at 902. The intended slope refers to the desired pressure ramp rate. This is used, along with an estimate of the intended initial pressure, to determine a generated pressure at 904. A steady state pressure to voltage characterization at 906 allows a corresponding voltage ramp rate to be determined. An error between the actual pressure ramp rate and the commanded pressure ramp rate is used by a comparator to determine a gain adjustment which is applied along with the commanded voltage ramp rate to determine a final command of the voltage that is applied at 910. In this way, the controller may convert a desired pressure ramp rate to a voltage ramp rate, apply the voltage ramp rate to the lift pump, learn a gain to apply to a lift pump command based on a difference between an actual pressure ramp rate, sensed upon applying the voltage ramp rate, and the desired pressure ramp rate; and finally adjust the lift pump command ramp rate based on the learned gain.

Example calibration profiles of the fuel lift pump are shown with reference to FIGS. 4-5. Specifically, map 400 of FIG. 4 shows the performance of a lower-output-than-nominal pump while map 500 of FIG. 5 shows the performance of a higher-output-than-nominal pump. In FIGS. 4 and 5, the commanded voltage is shown at plots 406, 506 (solid line) and the commanded pressure change is shown at plots 402, 502 (solid line). In comparison, the actual voltage is shown at plots 408, 508 (dashed line) and the actual measured pressure change is shown at plots 404, 504 (dashed line). In both cases, a first time point T1 of data collection is selected around a trough pressure, while a second time point T2 of data collection is selected when the voltage signal ceases to be applied. The pressure points collected at T1 and T2 are designated P1 and P2, respectively. All plots are shown over time.

In the example shown at FIG. 4, a ratio of the actual rate of rise of fuel pressure relative to the rate of rise of the applied pulse voltage is lower than the commanded rate of rise of fuel pressure relative to the commanded rate of rise of the applied pulse voltage. The ratio is 0.8. In other words, a multiplier of 0.8 is determined.

As an example, a nominal pump may produce a pressure ramp rate very close to the commanded ramp rate of 1200 kPa/s. In the example of FIG. 4, the measured pressure rise rate is 763 kPa/s. This corresponds to a pressure ramp rate of 228 kPa in 0.299 seconds (763 kPa/s). As a result, the actual feedforward characteristic of the pump is determined to be 0.8 times the nominal characteristic. In the example of FIG. 5, the measured pressure rise rate is 1958 kPa/s. This corresponds to a pressure ramp rate of 280 kPa in 0.143 seconds (1958 kPa/s). As a result, the actual feedforward characteristic of the pump is determined to be 1.2 times the nominal characteristic. Turning now to FIG. 6, map 600 depicts fuel rail pressure control via pulsed lift pump operation. Plot 604 depicts the rate of change of fuel rail pressure while plot 602 depicts the change in input current or voltage applied to the fuel lift pump during a pulsed mode of operation. All plots are depicted over time.

FIG. 7 shows a prophetic example of a timeline 700 of a fuel lift pump calibration event. The fuel lift pump may be coupled to an engine of a vehicle system. The calibration is performed independent of the mode of operation of the lift pump (pulsed or continuous). Plot 702 depicts engine speed. As an operator torque demand increases to accelerate a vehicle, engine speed increases. Plot 704 indicates the mode of operation, pulsed or continuous, of the fuel lift pump. Pump voltage applied to a motor of the pump by an engine controller is depicted at plot 706. Fuel rail pressure (FRP) is depicted at plot 708. The inlet pressure of a high pressure DI fuel pump coupled downstream of the lift pump is shown at plot 710. An indication as to whether fuel lift pump calibration is enabled (on) or disabled (off) is shown at plot 712. All plots are shown over time along the x-axis.

Prior to t1, the engine is operating at a mid speed-load range. Accordingly, the fuel pump is operating in the continuous mode. A target fuel rail pressure is attained by applying a constant voltage to the pump. The HPP inlet pressure is also maintained above a non-zero threshold 711, ensuring that there is no fuel vapor at the inlet. At this time, calibration conditions are not considered met.

At t1, there is a change in torque demand resulting in a shift to a higher engine speed-load range. The fuel pump is maintained in the continuous mode while raising the applied voltage to attain a higher target fuel rail pressure. The HPP inlet pressure remains above threshold 711.

At t2, while continuing to operate in the continuous mode, pump calibration conditions are met. For example, a threshold duration may have elapsed since a last pump calibration. The pump is calibrated by noting a first constant voltage v1 that is applied and a resulting fuel rail pressure p1. At t3, there is a change in torque demand resulting in a shift to a lower engine speed-load range. The fuel pump is maintained in the continuous mode while lowering the applied voltage to attain a lower target fuel rail pressure. Since the calibration mode is still on, another calibration data point is collected by noting a second constant voltage v2 that is applied and a resulting fuel rail pressure p2. The pump is then calibrated based on a ratio or difference between p1 relative to an expected value of p1 that is based on the applied voltage v1, and p2 relative to an expected value of p2 that is based on the applied voltage v2. In one example, an average of the two data points is used to calculate a pump calibration multiplier or addend.

At t4, calibration conditions end. Also due to a change in torque demand, the engine is shifted to a lower engine speed-load range necessitating a transition from the continuous mode to the pulsed mode of lift pump operation. Therein, the pump is operated intermittently. Specifically, at t4, the pump is switched off, and the HPP inlet pressure starts to gradually decay towards threshold 711. When the HPP inlet pressure is within a range of threshold 711, the pump is turned on by providing a pulse of voltage. In the depicted example, three pulses are provided between t4 and t5 to maintain the HPP inlet pressure above the threshold 711 and provide the desired fuel rail pressure.

At t5, while continuing to operate in the pulsed mode, pump calibration conditions are met. For example, a threshold duration may have elapsed since a last pump calibration in the pulsed mode. The pump is calibrated by ramping up the next pulse. Voltage is applied in the first pulse after t5 at a ramp rate depicted by slope s1. At the same time, a rate of change of the HPP inlet pressure is learned, specifically as derivative d1. Two more pulses are provided between t5 and t6 and accordingly voltage slopes s2 and s3, and respective pressure derivatives d2 and d3 are learned. The pump is then calibrated based on a ratio of s1 relative to d1, s2 relative to d2, and s3 relative to d3. In one example, an average of the three data points is used to calculate a pump calibration multiplier.

At t6, calibration conditions end. Due to no significant change in torque demand, the engine is maintained in the pulsed mode of lift pump operation. Further, pump operation is adjusted based on the learned pump calibration.

It will be appreciated that while the figure shows a ramped voltage being applied over the pulsed duty cycles, in alternate examples, the ramped duty cycle may include power, speed, or current ramped over a duration of a given pulse.

In this way, fuel lift pump calibration can be enabled even when the pump is operated in a pulsed mode. By ramping the pulse, the effect of a change in voltage on a change in fuel pressure can be learned even when the applied voltage is low in magnitude and duration. The technical effect of correlating a ramp rate of the voltage applied on a given fuel pump pulse with a corresponding change in fuel pressure is that the voltage-to-pressure relationship can be used to calibrate the lift pump. By calibrating the pump while ramping the applied voltage, the interfering effect of pump resistance on pump characterization is reduced. At the same time, the fuel economy benefits of the pulsed mode of pump operation can be achieved. By completing calibration over a drive cycle, pump performance is improved.

An example method for a fuel system comprises: operating a fuel lift pump in a pulsed energy mode with a ramped duty cycle; and adjusting a lift pump command ramp rate responsive to a measured ramped rate of pressure downstream of the lift pump during the ramped duty cycle. In the preceding example, additionally or optionally, the downstream pressure is a fuel rail inlet pressure. In any or all of the preceding examples, additionally or optionally, the rail inlet pressure is for a port injection fuel rail. In any or all of the preceding examples, additionally or optionally, the downstream pressure is a pump outlet pressure estimated downstream of the fuel lift pump and upstream of a high pressure fuel pump. In any or all of the preceding examples, additionally or optionally, the adjusting includes increasing ramp rate proportionally to a positive difference between a desired pressure ramp rate and the downstream pressure ramp rate. In any or all of the preceding examples, additionally or optionally, the adjusting further includes adjusting a degree of proportional adjustment based on pump temperature. In any or all of the preceding examples, additionally or optionally, the adjusting includes: converting a desired pressure ramp rate to a voltage ramp rate; applying the voltage ramp rate to the lift pump; learning a gain to apply to a lift pump command based on a difference between an actual pressure ramp rate, sensed upon applying the voltage ramp rate, and the desired pressure ramp rate; and adjusting the lift pump command ramp rate based on the learned gain. In any or all of the preceding examples, additionally or optionally, the converting includes converting via a steady-state nominal characterization. In any or all of the preceding examples, additionally or optionally, operating the lift pump in the pulsed energy mode includes applying electrical power to the lift pump for a duration of each pulse and then disabling the electrical power, the electrical power applied responsive to a lower than threshold pressure at an inlet of a high pressure pump coupled downstream of the fuel lift pump.

Another example method for a fuel system comprises: while operating a fuel lift pump in a pulsed energy mode, ramping up an applied voltage within a pulse at a ramp rate based on a desired ramp rate of fuel pressure; monitoring a resulting ramp rate of fuel pressure measured downstream of the lift pump; and adjusting a lift pump command based on the measured ramp rate of fuel pressure relative to the desired ramp rate. In the preceding example, additionally or optionally, the applied voltage within the pulse is ramped up at a higher rate as the desired ramp rate of fuel pressure increases. In any or all of the preceding examples, additionally or optionally, the lift pump command includes a commanded ramp rate, and wherein the adjusting includes increasing a gain applied to the lift pump command as the desired ramp rate exceeds the measured ramp rate. In any or all of the preceding examples, additionally or optionally, the fuel pressure measured downstream of the lift pump includes one of a lift pump outlet pressure, a port injection fuel rail inlet pressure, and a high pressure fuel pump inlet pressure. In any or all of the preceding examples, additionally or optionally, operating in the pulsed mode includes applying electrical power to the lift pump for a duration of each pulse and then disabling the electrical power, the electrical power applied responsive to a lower than threshold pressure at an inlet of a high pressure pump coupled downstream of the fuel lift pump. In any or all of the preceding examples, additionally or optionally, the lift pump command is further adjusted as a function of one or more of pump temperature, fuel temperature, and altitude.

An example fuel system for a vehicle comprises: a lift pump coupled inside a fuel tank; a fuel rail coupled downstream of the lift pump; a pressure sensor coupled in a fuel line between an outlet of the lift pump and an inlet of the fuel rail; and a controller with computer readable instructions stored on non-transitory memory that when executed cause the controller to: calibrate the lift pump while operating in a continuous energy mode wherein a voltage is continuously applied, the lift pump calibrated based on a desired fuel pressure corresponding to the continuously applied voltage relative to a sensed fuel pressure; calibrate the lift pump while operating in a pulsed energy mode wherein the voltage applied over each of a plurality of pulses is ramped up at a rate based on a desired fuel pressure ramp rate, the lift pump calibrated based on the desired fuel pressure ramp rate and a sensed fuel pressure ramp rate; and adjust a lift pump command based on the calibrations. In the preceding example, additionally or optionally, adjusting the lift command includes, while operating in the continuous energy mode, increasing the applied voltage in proportion to a positive difference between the desired fuel pressure and the sensed fuel pressure, and wherein adjusting the lift command further includes, while operating in the pulsed energy mode, increasing the rate of ramp rate of the applied voltage in proportion to a positive difference between the desired fuel pressure ramp rate and the sensed fuel pressure ramp rate. In any or all of the preceding examples, additionally or optionally, the system further comprises a temperature sensor, wherein the controller includes further instructions that further adjust the lift pump command based on a sensed pump temperature. In any or all of the preceding examples, additionally or optionally, the lift pump command is further increased as the sensed pump temperature increases. In any or all of the preceding examples, additionally or optionally, the fuel rail is coupled to a port fuel injector.

In another representation, the vehicle system is a hybrid vehicle system.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a fuel system, comprising:

operating a fuel lift pump in a pulsed energy mode with a ramped duty cycle; and adjusting a lift pump command ramp rate responsive to a measured ramped rate of pressure downstream of the lift pump during the ramped duty cycle.

2. The method of claim 1, wherein the downstream pressure is a fuel rail inlet pressure.

3. The method of claim 2, wherein the rail inlet pressure is for a port injection fuel rail.

4. The method of claim 1, the ramped duty cycle includes one of a ramped voltage, a ramped current, and a ramped pump speed.

5. The method of claim 4, wherein the adjusting further includes adjusting a degree of proportional adjustment based on pump temperature.

6. The method of claim 1, wherein the adjusting includes increasing ramp rate proportionally to a positive difference between a desired pressure ramp rate and the downstream pressure ramp rate.

7. The method of claim 1, wherein the adjusting includes:

converting a desired pressure ramp rate to a voltage ramp rate;

applying the voltage ramp rate to the lift pump;

learning a gain to apply to a lift pump command based on a difference between an actual pressure ramp rate, sensed upon applying the voltage ramp rate, and the desired pressure ramp rate; and adjusting the lift pump command ramp rate based on the learned gain.

8. The method of claim 7, wherein the converting includes converting via a steady-state nominal characterization.

9. The method of claim 1, wherein operating the lift pump in the pulsed energy mode includes applying electrical power to the lift pump for a duration of each pulse and then disabling the electrical power, the electrical power applied responsive to a lower than threshold pressure at an inlet of a high pressure pump coupled downstream of the fuel lift pump.

10. A method for a fuel system, comprising:

while operating a fuel lift pump in a pulsed energy mode, ramping up an applied voltage within a pulse at a ramp rate based on a desired ramp rate of fuel pressure;

monitoring a resulting ramp rate of fuel pressure measured downstream of the lift pump; and adjusting a lift pump command based on the measured ramp rate of fuel pressure relative to the desired ramp rate.

11. The method of claim 10, wherein the applied voltage within the pulse is ramped up at a higher rate as the desired ramp rate of fuel pressure increases.

12. The method of claim 10, wherein the lift pump command includes a commanded ramp rate, and wherein the adjusting includes increasing a gain applied to the lift pump command as the desired ramp rate exceeds the measured ramp rate.

13. The method of claim 10, wherein the fuel pressure measured downstream of the lift pump includes one of a lift pump outlet pressure, a port injection fuel rail inlet pressure, and a high pressure fuel pump inlet pressure.

14. The method of claim 10, wherein operating in the pulsed mode includes applying electrical power to the lift pump for a duration of each pulse and then disabling the electrical power, the electrical power applied responsive to a lower than threshold pressure at an inlet of a high pressure pump coupled downstream of the fuel lift pump.

15. The method of claim 10, wherein the lift pump command is further adjusted as a function of one or more of pump temperature, fuel temperature, and altitude.

16. A fuel system for a vehicle, comprising:

a lift pump coupled inside a fuel tank;

a fuel rail coupled downstream of the lift pump;

a pressure sensor coupled in a fuel line between an outlet of the lift pump and an inlet of the fuel rail; and a controller with computer readable instructions stored on non-transitory memory that when executed cause the controller to:

calibrate the lift pump while operating in a continuous energy mode wherein a voltage is continuously applied, the lift pump calibrated based on a desired fuel pressure corresponding to the continuously applied voltage relative to a sensed fuel pressure;

calibrate the lift pump while operating in a pulsed energy mode wherein the voltage applied over each of a plurality of pulses is ramped up at a rate based on a desired fuel pressure ramp rate, the lift pump calibrated based on the desired fuel pressure ramp rate and a sensed fuel pressure ramp rate; and adjusting a lift pump command based on the calibrations.

17. The system of claim 16, wherein adjusting the lift command includes, while operating in the continuous energy mode, increasing the applied voltage in proportion to a positive difference between the desired fuel pressure and the sensed fuel pressure, and wherein adjusting the lift command further includes, while operating in the pulsed energy mode, increasing the rate of ramp rate of the applied voltage in proportion to a positive difference between the desired fuel pressure ramp rate and the sensed fuel pressure ramp rate.

18. The system of claim 16, further comprising a temperature sensor, wherein the controller includes further instructions that further adjust the lift pump command based on a sensed pump temperature.

19. The system of claim 18, wherein the lift pump command is further increased as the sensed pump temperature increases.

20. The system of claim 16, wherein the fuel rail is coupled to a port fuel injector.

* * * * *